United States Patent [19]

Steiert

[11] Patent Number: 5,037,292

[45] Date of Patent: Aug. 6, 1991

[54] HEATER FOR MOTOR VEHICLE

[75] Inventor: Edwin Steiert, Wolfschlugen, Fed. Rep. of Germany

[73] Assignee: J. Eberspächer, Esslingen, Fed. Rep. of Germany

[21] Appl. No.: 439,455

[22] Filed: Nov. 20, 1989

[30] Foreign Application Priority Data

Nov. 23, 1988 [DE] Fed. Rep. of Germany ..... 3839535

[51] Int. Cl.[5] ..... F23N 5/24

[52] U.S. Cl. ..... 431/18; 237/2 A; 431/24

[58] Field of Search ..... 237/2 A, 12.3 A, 12.3 C, 237/12.3 B; 431/6, 24, 37, 63, 69, 18

*Primary Examiner*—Henry A. Bennett
*Attorney, Agent, or Firm*—McGlew & Tuttle

[57] ABSTRACT

Flame monitoring is normally performed in a space heater for a motor vehicle in order to stop the fuel supply within a certain period of time in the case of interruption of the flame. If interruption of the flame is detected by measuring the temperature on the heat exchanger or the combustion chamber of the heater in order to detect a possibly relatively rapid temperature drop, it must be ensured that the temperature at the test point can indeed decrease rapidly enough. It is therefore necessary constantly to monitor the electric motor of the blower for the combustion air or for the heating air flowing past the heat exchanger, so that the combustion chamber or the heat exchanger will indeed cool after interruption of the flame. The operation of the blower motor is monitored by briefly interrupting the power supply and measuring the generator voltage generated by the motor that continues to rotate. If there is no generator voltage or it is too low, a malfunction indication is generated.

15 Claims, 2 Drawing Sheets

HEATER FOR MOTOR VEHICLE

FIELD OF THE INVENTION

The present invention pertains to an engine-independent heater fired with liquid fuel for a motor vehicle, comprising a burner, a heat exchanger, a fuel supply unit, a combustion air blower driven by an electric motor, and a flame monitoring device.

BACKGROUND OF THE INVENTION

Heaters of this type are, e.g., space heaters for passenger cars, trucks or buses, which operate independently of the drive engine of the motor vehicle. The liquid fuel (gasoline, diesel fuel) is burned in a burner while combustion air is supplied. The combustion chamber is typically surrounded by a heat exchanger through which air or water flows.

For safety reasons, regulations normally require that the fuel supply be stopped within a certain period of time in the case of interruption of the flame in order to prevent the risk of explosion or the like, because interruption of the flame during the operation of a heater usually means a malfunction that must be eliminated by all means.

Interruption of the flame can be recognized in many different ways: for example, the use of an optical sensor is common and known. However, this solution may be problematic because of the difficulty of arranging the optical sensor in the appropriate place.

Another possibility for flame monitoring is to measure the temperatures in the combustion space or at the heat exchanger or at the combustion chamber to infer interruption of the flame from a drop in temperature. However, a drop in temperature outside the combustion chamber or at the heat exchanger that can be evaluated by the flame monitoring device takes place only if there is no stagnant air in the combustion chamber or at the heat exchanger. For example, if the flame has been interrupted and the combustion air blower is also not in operation, the heated air will stagnate in the combustion chamber, so that the temperature on the combustion chamber drops only slowly. The drop in temperature is thus recognized too late, long after the expiration of the required period of time within which the fuel supply has to be stopped.

Consequently, delivery of combustion air into the combustion chamber or blowing of heating air past the heat exchanger must be ensured even after interruption of the flame. It is only under these conditions that the temperature on the combustion chamber or in the heat exchanger will drop rapidly enough after interruption of the flame to permit the interruption of the flame to be recognized.

Measuring the power consumption of the motor to monitor the electric motor driving the blower has been common practice hitherto. If the power consumption is within a certain nominal range, this is evaluated as implying proper operation of the blower motor. Monitoring the power consumption by a reed relay operated with electric current in conjunction with a fuse in the motor circuit has also been common practice.

A safety circuit for engine-independent heaters for motor vehicles, which affects the operation of the heating blower, is disclosed in DE (West German) Patent Specification No. 37,38,739 A1. To prevent overheating in the case of malfunction of the heating blower, a coil, which is associated with a Hall generator, is included in the circuit of the heating air blower. Under normal conditions, the Hall generator generates a signal characterizing normal operation, because it senses the magnetic field generated by the coil through which the current flows. With the motor of the heating air blower stopped, no current flows, and the coil does not generate any magnetic field, so that the Hall generator sends an appropriate malfunction signal to the control device, which will thereupon interrupt the fuel supply.

SUMMARY AND OBJECT OF THE INVENTION

It is an object of the present invention is to provide a flame monitoring device that is simplified compared to the state of the art, especially for monitoring the operation of the blower motor, with which reliable results can be obtained.

According to the invention the device for monitoring the operation of the blower motor, includes a part of the flame monitoring device, comprising: a switching means for interrupting the power supply to the electric motor at certain intervals of time, and measuring means, which measures and evaluates the generator voltage generated by the motor during the interruption of the voltage.

The interruptions always occur only for very short periods of time, so that the motor speed is hardly reduced during the period of disconnection from the power source. The generator voltage generated by the motor, which is regarded as a generator here, is measured during this short period of time. If the motor has a certain minimum speed, a generator voltage proportional to the speed is generated. The measuring device evaluates the generator voltage. If it is above a certain level, the blower motor is assumed to be operating correctly. If the generator voltage is too low, e.g., a malfunction indication is generated. This feature is extremely useful as if the blower motor is unable to operate, interruption of the flame cannot be satisfactorily recognized by measuring the temperature on the combustion chamber or the heat exchanger.

In a further development of the present invention, the measuring device has a control unit that compares the generator voltage to a preset value. The present invention is particularly advantageous in conjunction with a microprocessor control unit which performs other control tasks as well. To monitor the operation of the blower motor, the switching device need only be equipped with a measuring device, and the microprocessor will control the operation of the switching device and receive the generator voltage signals from the measuring device.

In particular, the switching device contains a switching unit that is actuated such that it disconnects the terminals of the electric motor from the power source for predetermined periods of time.

Based on the generator voltage signal, the control device is initially able to determine whether a generator voltage is being generated at all. If there is no generator voltage, this always means that the motor has stopped. If the generator voltage is present, it is possible to determine in an additional processing step whether the generator voltage is above a preset minimum.

The suitable minimum for the generator voltage can be stored in advance, depending on the type of the blower motor.

If the heater is designed for different heat outputs and the blower motor correspondingly has different rated speeds for the different heating levels, the microprocessor control device can use different minima for the generator voltage, depending on the heating level set, as a reference basis for the comparison.

The time periods during which the generator voltage is determined are very short, preferably shorter than 1 sec. The time intervals between the generator voltage checks amount to, e.g., 4 minutes, which corresponds to the period of time within which interruption of the flame must be detected and the fuel supply must be stopped.

Accordingly, it is an object of the invention to provide an engine independent liquid fuel fired heater arrangement for a motor vehicle comprising a burner, a fuel supply unit connected to the burner, a blower for supplying air to the burner, an electric motor connected to the blower and flame monitoring means for termination of fuel supply upon detecting an interruption of flame in the burner. The monitoring means includes a switching device for interrupting the power supply to the electric motor at certain predetermined intervals of time and a measuring device for measuring and evaluating a generator voltage generated by the motor during the interruption of power. By this arrangement, it is possible to provide a more reliable monitoring arrangement for the flame in the burner as the speed and operation of the motor is monitored along with the normal temperature monitoring, thereby providing a reliable indication of the presence of the flame in the burner.

The various features of novelty which characterize the invention are pointed out with particularity in the claims annexed to and forming a part of this disclosure. For a better understanding of the invention, its operating advantages and specific objects obtained by its uses, reference is made to the accompanying drawings and descriptive matter in which a preferred embodiment of the invention is illustrated.

DETAILED DESCRIPTION OF THE PREFERRED EMBODIMENT

Figure 1:
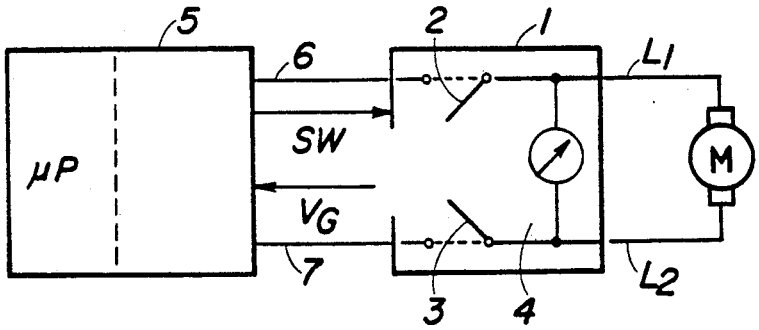
FIG. 1 is a schematic view of a blower motor with the associated control device and the switching device.

Referring to the drawings in particular, the invention embodied therein comprises an engine independent liquid fuel heater arrangement for a motor vehicle, comprising a burner 20 connected to a heat exchanger 22 and also connected to a blower 24. The blower supplies combustion air to the burner for combustion of fuel supplied by fuel supply 26. As shown in FIG. 1, the blower motor M is connected to a flame monitoring includes switching means. The flame monitoring means which switches the power supply of the electric motor at certain intervals of time to interrupt the power supply in such that measurements may be taken during the interruption to determine the voltage generated by the motor, thereby providing information with regard to the function of the blower. The flame monitoring means also includes an arrangement which monitors the temperature at the heat exchanger, the combined information of the blower function and the temperature at the heat exchanger may then be used to detect the interruption of the flame and thereby cut off the fuel supply at fuel supply 26.

According to FIG. 1, a blower motor M provided to generate the combustion air or the heating air is supplied with power via two lines 6 and 7 of a power supply unit via two line terminals L1, L2 and a switching and measuring device generally designated by reference numeral 1. The power supply unit is located within a unit represented as a block 5, which contains a microprocessor ($\mu$P), which also performs other control functions, and a driving circuit for the motor.

The switching and measuring device 1 of the flame monitoring means contains a switch 2 and 3 and a digital or analog voltmeter 4.

FIG. 1 shows in solid lines the state in which the motor M is connected to the measuring device 4 via said lines L1 and L2 and said switches 2 and 3, so that said measuring device 4 constantly measures the generator voltage $V_G$ generated by the rotating motor M, which is proportional to the motor speed. The voltage $V_G$ is sent via a signal line to the microprocessor contained in the block 5. In FIG. 1, the microprocessor has previously sent a switching signal to said switches 2 and 3 via a control line SW, so that the switches have reached the position represented by solid lines from the position shown in broken lines. In the position shown in broken lines, the switches 2 and 3 connect the lines 6 and L1 and 7 and L2, respectively.

The blower motor M is part of a liquid fuel-fired heater that is independent of the vehicle engine, e.g., of a space heater of a motor vehicle. The other parts of the heater are not shown here. To detect an interruption of the burner flame of the heater, which represents a malfunction, by detecting a drop in temperature at the heat exchanger or at the combustion chamber, it must be ensured that the temperature at the heat exchanger or the combustion chamber will really decrease in the case of interruption of the flame, rather than declining only very slowly due to stagnant heat. The blower motor is therefore monitored as soon as or shortly after the blower is turned on. The flow of combustion air through the combustion chamber, which cools the combustion chamber, and the flow of heating air past the heat exchanger to cool it because of lack of heating energy in the combustion chamber, are guaranteed only when the blower motor is in operation.

Figure 2A:
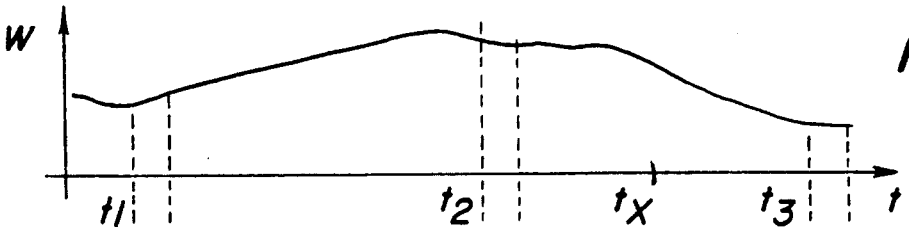
FIG. 2*a* is a graphical representation showing the changes in the speed of the blower motor, according to FIG. 1, over time.
Figure 2B:
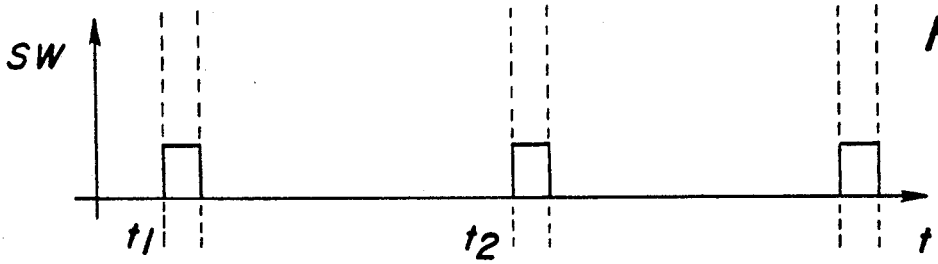
FIG. 2*b* is a graphical representation showing a pulse diagram of switching pulses.
Figure 2C:
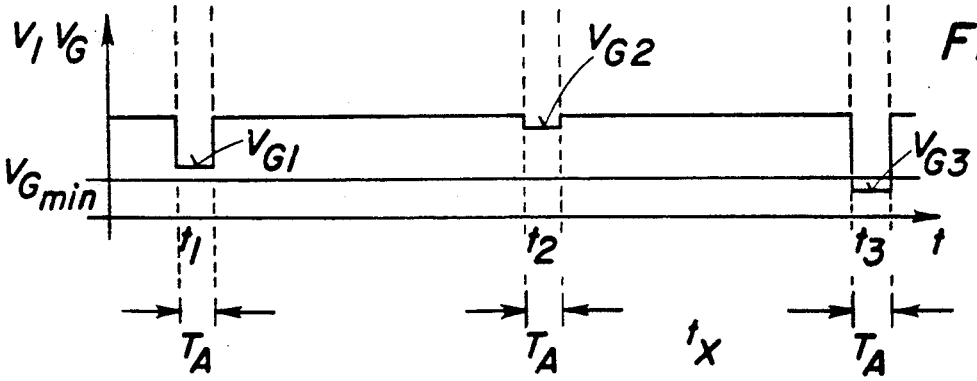
FIG. 2*c* is a graphical representation showing polled values of the generator voltage.
Figure 3:
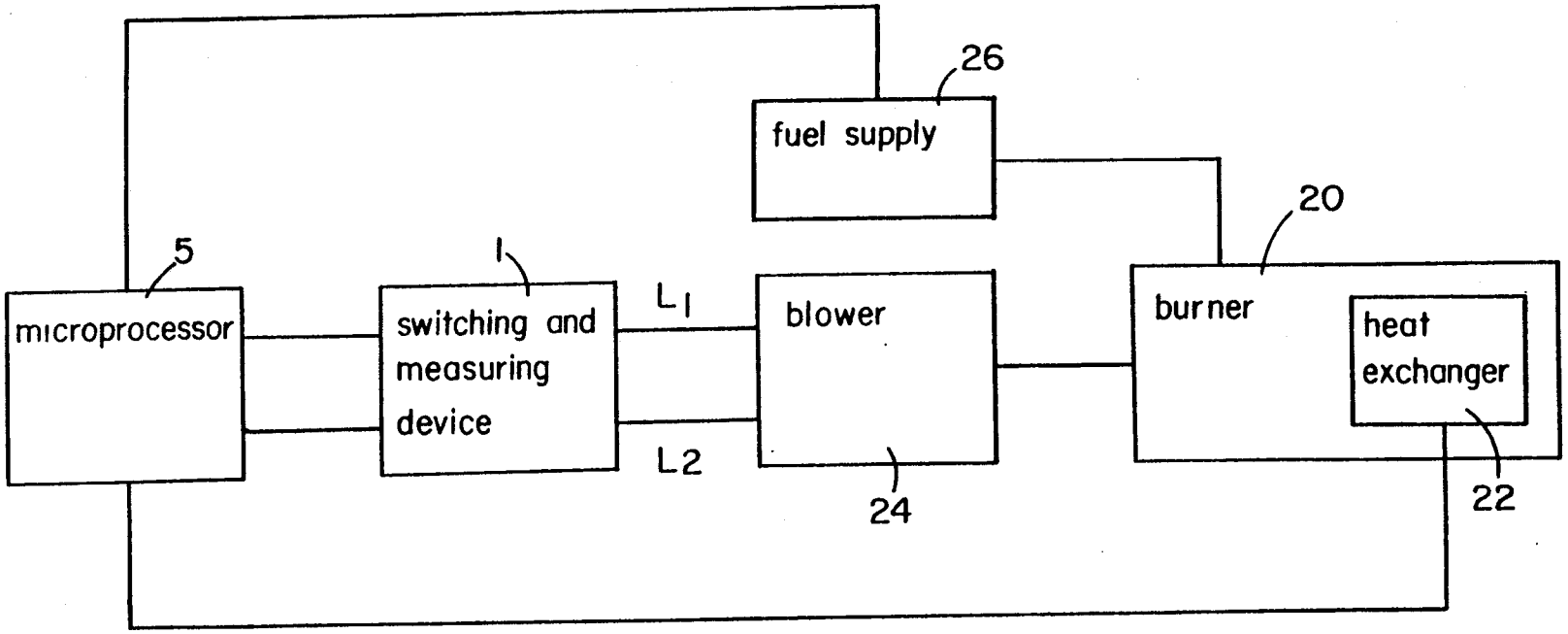
FIG. 3 is a schematic view showing a preferred layout of of a burner employing the flame detector of the invention.

The operation of the blower motor monitoring device according to FIG. 1 will be briefly explained on the basis of FIGS. 2*a* through 2*c*. FIG. 2*a* shows the possible changes in the speed of motor M. Up to a time $t_2$, the speed varies within certain limits. The speed is more or less constant even after time $t_2$. The speed begins to decrease at time $t_x$ because of a malfunction that is of no particular interest here.

As is apparent from FIG. 2*b*, a switching pulse SW, which causes switching of the selector switches 2 and 3 according to FIG. 1, is generated at certain intervals of time, e.g., every 42 sec, at the times $t_1$, $t_2$, $t_3$, etc. The generator voltage $V_G$ generated by the rotating motor is measured subsequent to the times $t_1$, $t_2$, etc., for a certain period of time $T_A$ of, e.g., 0.5 sec, during which time the measuring device 4 is connected to the motor.

The measured value is sent to the microprocessor control device.

As is apparent from FIG. 2c, the generator voltages $V_{G1}$ and $V_{G2}$ measured at the times $t_1$ and $t_2$, respectively, have values that are above a lower limit value $V_{Gmin}$.

At time $t_3$ the speed of the motor has already dropped substantially, and a generator voltage that is below the lower limit value $V_{Gmin}$ will consequently be measured. This is detected by a comparison performed in the microprocessor control device 5, and a malfunction indication is issued.

The microprocessor can be programmed such that before a comparison is made, it is first determined whether a generator voltage is present at all. If there is no generator voltage within an interval between two measurements, the comparison does not need to be performed at all.

While a specific embodiment of the invention has been shown and described in detail to illustrate the application of the principles of the invention, it will be understood that the invention may be embodied otherwise without departing from such principles.

What is claimed is:

1. An engine independent liquid fuel fired heater arrangement for a motor vehicle, comprising: a burner; a fuel supply unit connected to the burner; a blower for supplying air to the burner; an electric motor connected to the blower for driving the blower; and, flame monitoring means for detecting an interruption of a flame in the burner, the flame monitoring means including switching means for interrupting the supply of power to the electric motor at pre-determined time intervals and measuring means for measuring a generator voltage generated by the motor during the periods of interruption of power.

2. A heater arrangement according to claim 1, wherein said switching means switches the motor off as a single pole switch.

3. A heater arrangement according to claim 1, wherein said switching means includes a selector switch for connecting the measuring device to the electric motor only during a measuring phase, during interruption of the power.

4. A heater arrangement according to claim 1, wherein said measuring means includes a processing unit for comparing said generator voltage with a pre-set value.

5. A heater arrangement according to claim 1, wherein said switching means is actuated to disconnect the terminals of the electric motor from a power source for a pre-determined period of time and at pre-determined intervals of time.

6. A heater arrangement according to claim 1, wherein said measuring means includes means for determining whether the switching device has opened by observing whether the generator voltage is three percent lower than the operating voltage previously observed.

7. The heater arrangement according to claim 6, wherein said measurement means monitors the water pump motor and/or the heating blower of the heater.

8. An engine independent liquid fuel fired heater arrangement for a motor vehicle, comprising: a burner; a fuel supply unit connected to said burner; a blower for supplying air to the burner; an electric motor connected to the blower for driving the blower; a heat exchanger positioned for receiving heat from said burner; means for measuring the temperature of the heat exchanger; and, switching means for interrupting the supply of power to the electric motor at pre-determined time intervals and measuring means for measuring a generator voltage, generated by the motor, during the periods of interruption of power.

9. A heater arrangement according to claim 8, wherein said switching means switches the motor off as a single pole switch.

10. A heater arrangement according to claim 8, wherein said switching means includes a selector switch for connecting the measuring device to the electric motor only during a measuring phase, during interruption of the power.

11. A heater arrangement according to claim 8, wherein said measuring means includes a processing unit for comparing said generator voltage with a pre-set value.

12. A heater arrangement according to claim 8, wherein said switching means is actuated to disconnect the terminals of the electric motor from a power source for a pre-determined period of time and at pre-determined intervals of time.

13. A heater arrangement according to claim 8, wherein said measuring means includes means for determining whether the switching device has opened by observing whether the generator voltage is three percent lower than the operating voltage previously observed.

14. The heater arrangement according to claim 8, wherein said measurement means monitors the water pump motor and/or the heating blower of the heater.

15. An engine independent liquid fuel fired heater arrangement for a motor vehicle, comprising: a burner; a fuel supply unit connected to said burner; a blower for supplying air to the burner; an electric motor connected to the blower for driving the blower; a heat exchanger positioned adjacent said burner; flame monitoring means for detecting an interruption of a flame in the burner including means for measuring the temperature of the heat exchanger and including switching means for interrupting the supply of power to the electric motor at pre-determined time intervals and measuring means for measuring a generator voltage, generated by the motor, during the periods of interruption of power.

* * * * *